US005734350A

United States Patent [19]

Deming et al.

[11] Patent Number: 5,734,350

[45] Date of Patent: Mar. 31, 1998

[54] MICROSTRIP WIDE BAND ANTENNA

[75] Inventors: Douglas Robert Deming; Dax Craig; Robert Eugene Munson; Joseph Theofil Negler, all of Boulder, Colo.

[73] Assignee: Xertex Technologies, Inc., Boulder, Colo.

[21] Appl. No.: 629,230

[22] Filed: Apr. 8, 1996

[51] Int. Cl.[6] ..... H01Q 1/38

[52] U.S. Cl. ..... 343/700 MS; 343/846

[58] Field of Search ..... 343/700 MS, 830, 343/846, 872, 878, 882

[56] References Cited

U.S. PATENT DOCUMENTS

| | | | |
|---|---|---|---|
| 3,938,161 | 2/1976 | Sanford | 343/829 |
| 4,366,484 | 12/1982 | Weiss et al. | 343/700 MS |
| 4,816,838 | 3/1989 | Mizuno et al. | 343/700 MS |
| 4,835,541 | 5/1989 | Johnson et al. | 343/700 MS |
| 5,019,829 | 5/1991 | Heckman et al. | 343/700 MS |
| 5,210,542 | 5/1993 | Pett et al. | 343/700 MS |
| 5,355,142 | 10/1994 | Marshall et al. | 343/872 |
| 5,442,366 | 8/1995 | Sanford | 343/700 MS |
| 5,444,453 | 8/1995 | Lalezari | 343/700 MS |
| 5,532,707 | 7/1996 | Klinger et al. | 343/872 |

FOREIGN PATENT DOCUMENTS

| | | | |
|---|---|---|---|
| 0148302 | 11/1982 | Japan | 343/700 MS |

*Primary Examiner*—Hoanganh T. Le
*Assistant Examiner*—Tan Ho
*Attorney, Agent, or Firm*—E. C. Hancock; F. A. Sirr; Holland & Hart llp

[57] ABSTRACT

A Radio Frequency (RF) microstrip antenna employs a planar or curved radiator element that is mounted or supported in spaced relation to a planar or curved ground plane element. A RF feed is attached near one edge of the radiator element for receiving and/or transmitting RF signals in a lobe that is substantially perpendicular to the ground plane element. The radiator element and the ground plane element are maintained in a converging or tilted physical relationship. When a coaxial cable is employed as the antenna feed, the cable's outer insulation is secured to the ground plane element, the cable's center conductor extends away from the ground plane element to provide a signal feed to the radiator element and to provide physical support for one edge of the radiator element, and two insulator posts extend away from the ground plane element to provide support for the opposite edge of the radiator element.

42 Claims, 6 Drawing Sheets

| CENTER FREQUENCY MHz | BW % | L | W | $GP_l''$ | $GP_w''$ | $T_b$ | $T_f$ | $F_p$ |
|---|---|---|---|---|---|---|---|---|
| 2440 | 5.7 | 1.94 | 2.48 | 4.75 | 4.75 | 0.42 | 0.26 | 0.20 |
| 1964 | 8.5 | 2.41 | 3.24 | 6 | 6 | 0.59 | 0.20 | 0.24 |
| 933 | 4.0 | 5.35 | 6.64 | 10 | 12 | 0.94 | 0.28 | 0.20 |
17,19 16,18 31,32 33,34 55 54 80
Fig. 4
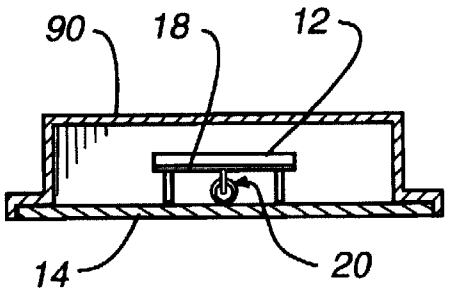
Fig. 6
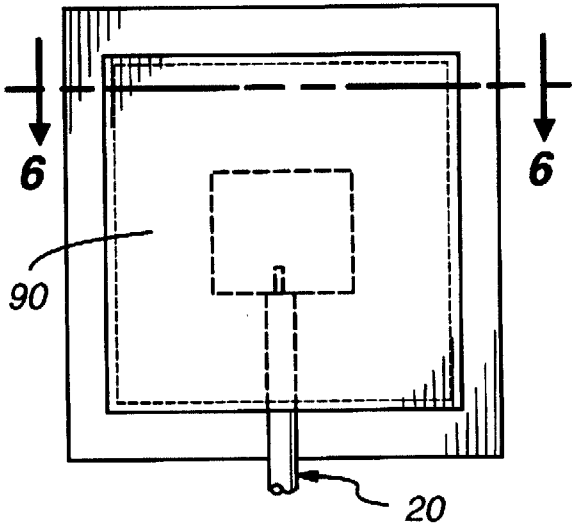
Fig. 5

CIRCULAR POLARIZATION

DUAL POLARIZATION

MICROSTRIP WIDE BAND ANTENNA

BACKGROUND OF THE INVENTION

1. Field of the Invention

The present invention relates to antennas for receiving and transmitting Radio Frequency (RF) signals. More particularly, the present invention relates to small RF microstrip antennas having a relatively low or thin height profile. While not necessarily limited thereto, the present invention is particularly useful for the exchange of high frequency RF signals at relatively low power.

2. Description of the Related Art

Several varieties of Radio Frequency (RF) antennas have evolved in the past. For instance, U.S. Pat. No. 5,444,453 by Lalezari describes a parallel plate, inverted, microstrip type of antenna using air as a dielectric, and intended to operate in the 10 to 40 GigaHertz range. A relatively large dielectric plate (i.e., 1×1 to 2×2 inch square plates, or one to two inch diameter circular plates) operates to physically support a smaller metallic radiator patch that is centrally located over a metallic ground plane member, the ground plane member being about the same size as the dielectric plate. A number of support posts of substantially the same height operate to maintain a uniform 0.1 mm to 1.0 mm spacing between the dielectric plate and the ground plane member.

In addition, U.S. Pat. No. 5,442,366 to Sanford describes a raised patch antenna structure for the circular polarized transmission and reception of signals, wherein a raised patch antenna element is provided at the top surface of a hollow cube-shaped housing. The flat bottom surface of the cube comprises a feed base portion having phasing means and power dividing means for the four walls of the cube. Each cube wall contains a feed-leg line, whereby the two pairs of opposite sides of the raised patch antenna element are feed with balanced signals of equal amplitude that are 180-degrees out of phase. Each of the four feed-legs includes an impedance matching means.

Additional examples of microstrip antennas include U.S. Pats. No. 3,938,161 to Sanford and 5,210,542 to Pett et al.

While prior antennas, as above exemplified, are generally satisfactory for their limited intended purposes, the need remains in the art for a small, low profile, microstrip antenna that is aesthetically pleasing to the human eye, whose physical shape generally disappears to human view when the antenna is mounted in a use environment, and which antenna is of a minimum-part construction and arrangement that provides exceptional radiation/reception performance improvements.

SUMMARY OF THE INVENTION

The present invention finds utility in a wide variety of signal transmission applications, and it is especially useful for the specialized needs of wireless communication equipment, such as those operating in the unlicensed (U.S.A.) 2.4 to 2.4835 Giga Hertz (GHz) frequency band.

The present invention provides a physically small antenna, for example, a square 4.755-inch by 4.755-inch box-like structure that is 0.66-inch thick, or a rectangular 10-inch by 8-inch box-like structure that is ⅞-inch thick; i.e., an antenna that is generally the size of the well-known domestic smoke detectors. Preferably, an antenna in accordance with this invention is provided in a conformal design whose base fits relatively flush against a flat support structure, such as a vertically extending wall, or against a curved support structure, such as an antenna mast.

This invention advantageously utilizes a metal planar, or curved active element, also sometimes called a radiating element or a radiating patch, wherein the surface of the radiating element is oriented at an angle (i.e., the radiating element is tilted) relative to an adjacent surface of a metal planar or curved ground plane element. The angled or tilted construction and arrangement of the present invention operates to provide an aesthetically pleasing antenna whose physical shape almost disappears to human view in most environments, and yet the construction and arrangement of the present invention offers exceptional radiation/reception performance improvements, including a reduction in the antenna's feed inductance.

A general object of the present invention is to provide a microstrip antenna having a metallic ground plane element of a first shape and a first physical size, a metallic radiating element of a second shape that is generally identical to the above-mentioned first shape and of a second physical size that is smaller, or at least no larger than, the above mentioned first physical size of the ground plane element, with mounting means operating to position the radiating element at a fixed position and generally centered over the ground plane element, the mounting means operating to mount the radiating element away from the ground plane element to define a dielectric space between the radiating element and the ground plane element, and the mounting means additionally operating to mount the radiating element in an inclined attitude relative to the ground plane element, and wherein a signal feed means extends into this dielectric space, the signal feed means including metallic electrical conductor means that is fixed to a feed point on a surface of the radiating element that faces the ground plane element.

As a feature of this invention, the geometric shape of the radiating element and the ground plane element are both selected from the group flat-planar shape or partial-cylinder shape.

As an additional feature of this invention, the antenna may include a radome covering the assembly that consists of the ground plane element and the radiating element.

As an additional feature of this invention, the mounting means includes the use of a metallic electrical feed conductor to physically support the radiating element adjacent to one of its edges, while using first and second dielectric-material and physically spaced support posts of generally equal length to support an opposite edge the radiating element.

Those having normal skill in the art will recognize the foregoing and other objects, features, advantages and applications of the present invention from the following more detailed description of the preferred embodiments as illustrated in the accompanying drawings.

BRIEF DESCRIPTION OF THE DRAWINGS

FIG. 4 is a table providing the physical dimensions for three different physical antenna configurations in accordance with the present invention.

FIG. 5 is a top plan view of the antenna of 1, wherein a plastic radome has been added to physically cover and protect the antenna of FIG. 1.

FIG. 6 is a side and section view of the antenna of FIG. 5 as viewed from the back edge of the radiating element.

DETAILED DESCRIPTION OF THE PREFERRED EMBODIMENTS

A microstrip antenna in accordance with the present invention provides an increased bandwidth and consists of a minimum number of parts. An antenna in accordance with the invention, also provides lower manufacturing cost, better reliability, higher gain, and a lower weight when these various factors are compared to contemporary antennas.

For example, in the 2.4 to 2.4835 Ghz frequency range, an antenna in accordance with this invention, exhibits a typical gain of 9 dBi with a typical bandwidth of 140 Mhz, and typically a standing wave ratio (VSWR) of less than 1.5:1, with linear polarization. Typically, a 3 Db beamwidth for the directional pattern that is produced by an antenna in accordance with the invention is 55-degrees in the E-plane and is 60-degrees in the H-plane.

A typical, but nonlimiting utility of an antenna in accordance with this invention, is use of the antenna in spread spectrum applications, such as wireless local area networks; for example, building-to-building wireless computer systems.

Figure 1:
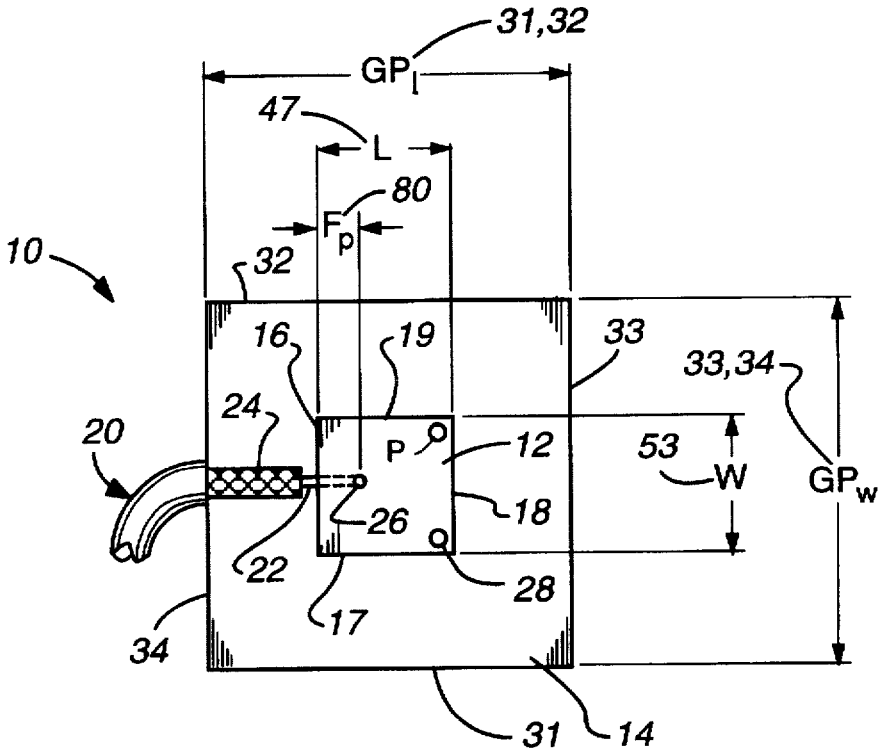
FIG. 1 is a top plan view of a square-configuration antenna embodiment of the present invention.
Figure 2:
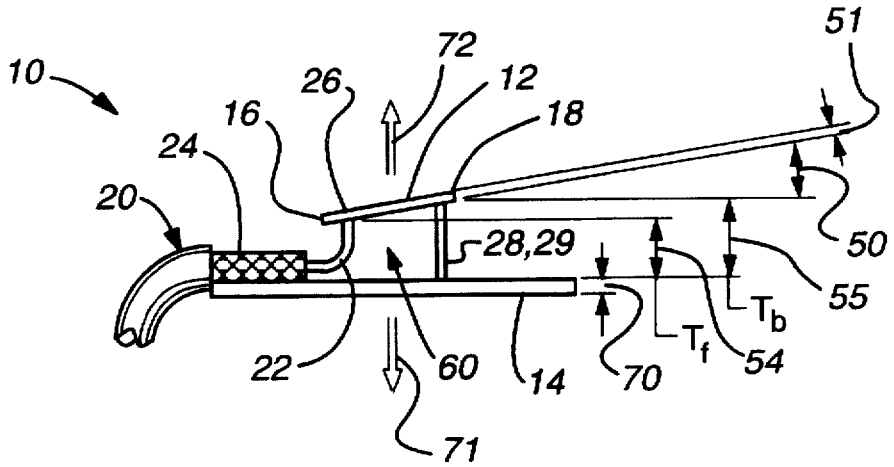
FIG. 2 is a side view of the FIG. 1 embodiment, wherein the radiating element is tilted downward toward the antenna's feed cable.

FIG. 1 is a top plan view of a microstrip antenna 10 in accordance with this invention, and FIG. 2 is a side view of the antenna of FIG. 1.

Figure 3:
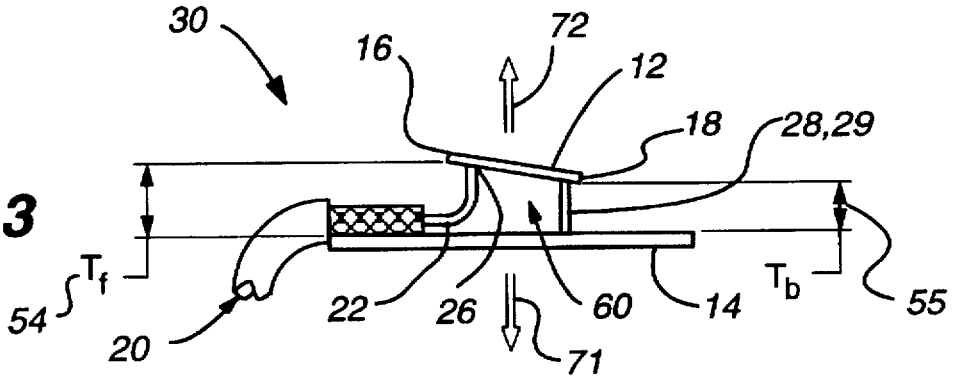
FIG. 3 is a side view of another embodiment of the present invention, wherein the radiating element is tilted upward and away from the antenna's feed cable.

Flat, generally square, metal, and planar radiating element 12, or radiating patch 12, is physically oriented so that the physical plane that is occupied by radiating element 12 extends in a converging relation (i.e., in a non-parallel relation) to the plane that is occupied by a flat, generally square, metal, and planar ground plane element This non-parallelism of radiating element 12 to ground plane 14 allows the antenna designer to very accurately match the impedance of antenna 10 to the impedance of the antenna's feed, as is defined by coaxial cable 20 (for example, by reducing the feed inductance), while using the single-unit construction and arrangement of FIGS. 1–3 that comprises a minimum number of individual parts.

No additional components beyond that shown in FIGS. 1–3 are required of the invention, for example, such as the additional component that are required in prior capacitively loaded microstrip antennas, wherein a capacitor is used to match the inductance of the feed to the impedance of the antenna.

Typically, a microstrip antenna can achieve limited bandwidth improvement by increasing the height of the physical space that exists between the antenna's radiating element and the antenna's ground plane element. Unfortunately, as this physical space increases (i.e., as the radiating element and the ground plane are moved apart), the antenna's inductance also increases, thus causing an impedance mismatch between that of the antenna and its feed. This mismatch between the antenna impedance and the feed impedance causes a portion of the feed power to be reflected back to the source, rather than being radiated into free space by the antenna, as is desired. The greater this reflected feed power, the less the power that is radiated from the antenna, thus reducing the gain of the antenna. Therefore traditionally, an increased antenna bandwidth was achieved at the expense of lowering the antenna gain, and at the expense of the need to provide a more complex and expensive feed.

This invention allows the antenna designer to increase the antenna's bandwidth without concomitantly increasing the antenna's inductance. Thus, in accordance with the construction and arrangement of this invention, the antenna's radiated power does not suffer when the antenna's bandwidth is increased. In accordance with this invention, the feature whereby the plane of radiating element 12 is angled, or titled, relative to the plane of ground plane 14, reduces the increase in antenna inductance that is usually caused by simply increasing the separation of a radiating element from its ground plane element in a uniform manner.

As a result of the construction and arrangement of this invention, the invention provides a nearly ideal impedance match of the antenna to its feed, and additionally provides a VSWR approaching the ideal VSWR of 1:1. A typical impedance match in accordance with the invention provides a VSWR of less than 1.15:1, and can provide a VSWR that is as low as 1.0001:1; i.e., nearly the ideal impedance match, these values of VSWR providing that nearly zero power is reflected back to the source due to an impedance mismatch. The antenna designer, therefore, may use this invention to produce an antenna having nearly 100% efficiency by virtue of the fact that tilting radiating element 12 relative to ground plane element 14 does not appreciably increase the impedance of the antenna.

It has been found that bandwidths of about 10% are achievable without sacrificing a perfect impedance match between the antenna and its feed, thus resulting in a microstrip antenna that has both a wide bandwidth and a high gain. It has also been found that in order to improve this impedance match, the plane that is occupied by radiating element 12 can be tilted in any direction relative to the plane that is occupied by ground plane element 14, and more generally, that the antenna impedance changes as the spacing of the radiating element to the antenna feed changes.

For example, radiating element 12 can be tilted so that its linear feed side 16 is lower then the linear, parallel, and oppositely disposed far side 18 of radiating element 12, as is shown for antenna 10 in FIGS. 1 and 2, or vice versa, as is shown for antenna 30 of FIG. 3. As shown in FIG. 1, radiating element 12 includes not only parallel feed side 16 and far side 18, but in addition, radiating element 12 includes two parallel inclined sides 17,19 that meet sides 16,18 at right angles. Sides 17,19 are defined as inclined sides since, in this embodiment of the invention, it is only these two sides that are inclined to ground plane element 14. As will be apparent, it is within the spirit and scope of this invention to incline all four sides 16–19 of radiating element 12 to ground plane element 14.

The direction in which radiating element 12 is tilted (compare FIG. 2 to FIG. 3) affects the center frequency of the antenna's bandwidth. Tilting radiating element 12 down toward the antenna's feed side that is established by cable 20, as in FIGS. 1 and 2, results in a lower center frequency, while tilting radiator element 12 away from the antenna's feed side 20 results in a higher center frequency.

Tests have shown that an antenna having a tilted radiating element 12 can be impedance matched to the antenna feed, with the antenna having a center frequency of about 2300 Mhz, by tilting radiating element 12 toward the antenna's feed side 20 as in FIGS. 1 and 2, and that an antenna having a center frequency of about 2000 Mhz can be impedance matched to its feed by tilting radiating element 12 away from the antenna's feed side 20, as in FIG. 3. Both of these tilt constructions for radiating element 12 relative to ground plane element 14 provide a bandwidth of about 10% and about 9 dBi of gain.

The angle 50 of tilting radiating element 12 can range vary, but potentially at the cost of a higher profile as tilt angle 50 increases, and ultimately the antenna's gain will decrease as tilt angle 50 increases The greater the angle of tilt 50, the greater the antenna's bandwidth increase, but this increased bandwidth is potentially achieved at the expense of a lower antenna gain, and the loss of a low antenna profile. Experiments show this bandwidth increase may vary from about 4% to about 25%, this percent value of increase being not only a function of the angle of tilt 50, but also being a function of the position of the antenna's feed point 26 on the bottom surface of radiating element 12 (to be described), the type of feed cable 20 that is used, and the physical height separation of radiating element 12 above the top surface of ground plane element 14.

In considering the design parameters of angled microstrip antenna 10 of FIGS. 1 and 2, or angled microstrip antenna 30 of FIG. 3, the physical elements that are required to make such a microstrip antenna in accordance with this invention consist of only a pair of support legs, and three additional major components; i.e., metal radiating element 12, metal ground plane 14, and metal signal connector 22 that is provided by feed cable 20.

Feed cable 20, as shown in FIGS. 1, 2 and 3, comprises a well-known coaxial cable 20 having a centrally located metal signal-conductor 22 which is preferably of sufficient physical strength to support and position a front edge or portion 16 of radiating element 12, as will be described. Typically, cable 20 includes an electrically grounded metal, wire-mesh, tubular sleeve 24, an external insulator sleeve that forms the outer periphery of cable 20, and an internal insulator sleeve that separates inner conductor 22 from grounded sleeve 24.

Radiating element 12 of FIGS. 1–3 is typically square/rectangular in shape, typically has a thickness 51 of about 1/64-inch, and typically is made from a solid copper sheet. In accordance with the spirit and scope of this invention, radiating element 12 can be constructed from any type of electrically conductive and thin material (i.e., typically less than 1/4-inch thick, and preferably 1/64-inch thick). Radiating element 12 can also be constructed from a metal-clad printed circuit substrate material, such as single-clad copper (½ ounce to 2 ounce, for example).

The physical area of radiating element 12 is preferably centered above the larger physical area of ground plane element 14. Generally, ground plane element 14 is of the same planar shape as radiating element 12, i.e. square/rectangular, and these two shapes are oriented so that their respective sides are generally coincident.

The length/width dimensions of radiating element 12 directly affect the radiating frequency of the antenna. The most critical dimension of radiating element 12 is the common length of its two sides 17, 19, i.e. its length 47 which is defined as L, which dimension controls the antenna's radiating frequency.

This length dimension 47, or L of radiating element 12, is generally or approximately established by the following formula:

$$L=(0.41) \text{ times } (\lambda o)/(\text{the square root of } Er)$$

Wherein $\lambda o$=the desired, or design, radiating wavelength in free-space, and Er=the relative dielectric constant of metal radiating element 12, or the dielectric constant of a metal-clad substrate, or printed substrate, that carries metal radiating element 12.

The length of the two sides 16, 18 of radiating element 12 that extend perpendicular to sides 17, 19, i.e. its width 53 which is defined as W, can be less than one wavelength of the antenna's center frequency, but is, of course, greater than zero, in order to avoid, or at least to minimize, exciting high-order frequency modes of the antenna. However, this width dimension W can also be equal to 2, 3, 4, or more wavelengths when a multiple feed network is provided from a common source, or from multiple sources. As W is reduced below 0.3 $\lambda o$, the radiation resistance and the efficiency of the antenna start to decrease.

The following equation is used to determine the common width dimension 53 of radiating element 12; i.e., the common length of edges 16 and 18, defined as W:

$$W=L/0.75$$

where L is the length 47 of radiating element 12.

Three different values of width 53, W, or sides 16,18 of radiating element 12 that correspond to the three different radiating wavelengths; i.e., the frequencies 2440,1964,933 Mhz, as well as the three corresponding values of length 47, L, or sides 17,19, is shown in FIG. 4.

As the width 53, W, or sides 16, 18 of radiating element 12 incremantally increases up to a value that is equal to $\lambda o$, the gain of the antenna will continue to incremantally increase. However, as this width dimension increases beyond this equal-to-value, radiating element 12 will excite higher order modes. When these wider radiating elements are nevertheless desired by the antenna designer, multiple antenna feed points, well known to those of skill in the art, can be provided for the antenna, to thus enable the antenna's gain to continue to increase even for these wider dimensions of radiating element 12.

The back-height spacing 54 of radiating element 12 from ground plane 14, as is measured at the far edge 18 of radiating element 12, and which is defined as Tb, will now be considered. Far edge 18 is, by definition, the edge of radiating element 12 that extends parallel to the edge 16 that is closest to feed point 26 on radiating element 12. As stated, feed point 26 is provided by the electrical connection of conductor 22 to the lower side or surface of radiating element 12.

The value of the distance Tb (i.e., the dimension that is measured in a perpendicular direction from ground plane 14 to far edge 18 of radiating element 12) is critical in determining the antenna's bandwidth.

The value of the dimension Tb is determined in accordance with the following equation:

$$Tb=(0.087)(\lambda o)$$

where $\lambda o$=the wavelength of the center frequency.

The front-height spacing 54 of front edge 16 of radiating element 12 from ground plane 14 is defined as Tf. The value of Tf is usually in the range of from about 0.2-inch to about 0.3-inch. Usually, the lower the value of Tf, the better will be the impedance match that is achieved between the impedance of the antenna and the impedance of connecting cable 20, since this lower value of Tf will operate to reduce the feed inductance of cable 20 that is generated by elevating radiating element 12 above ground plane 14.

It is common with use of the present invention to have a minimum VSWR of 1.0001:1, which provides nearly a perfect impedance match with no reflected power, and which also maximizes the antenna gain and radiated power.

Figure 9:
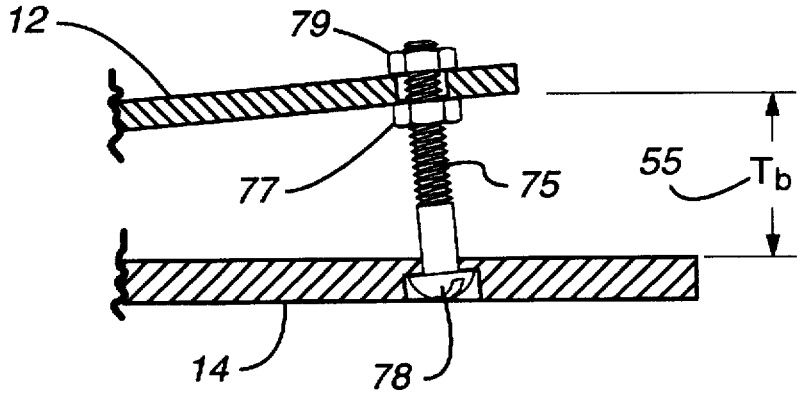
FIG. 9 shows an adjustable, nonconductive, nylon bolt that can be used to support the radiating element of the present invention relative to the antenna's ground plane element, for example, during a process of making a prototype antenna in accordance with the invention, which bolt can also be used to replace the two non-adjustable support posts that are shown in FIGS. 1–3.

Once the front distance 54 of radiating element 12, Tf, and the back distance 55 of radiating element 12, Tb, have both been determined as above described, this physical inclined position of radiating element 12 relative to ground plane 14 is established and then permanently fixed, for example, by using a nonconductive support material, such as two small cross section nylon bolts 75 as shown in FIG. 9, by using two small cross section Styrofoam posts 28,29, or by using other small cross section, rigid, and nonconductive post arrangements 28,29, to support the far edge 18 of radiating element 12 on and above ground plane 14.

The efficiency of an antenna in accordance with this invention decreases as a function of an increase in the dielectric constant of the material that occupies the physical space 60 between radiating element 12 and ground plane 14; for example, an air space 60.

Thus, it is preferable to provide two physically spaced and thin cross-section suspension posts 28 and 29 for radiating element 12, wherein the thin posts 28,29 are constructed, or formed, using a minimum amount of a low-dielectric material, so as to minimize the dielectric-volume of posts 28,29 that exists in space 60 between radiating element 12 and ground plane 14. Two Nylon bolts 75, as shown in FIG. 9, can be provided to support radiating element 12 in the manner of posts 28,29. The physical location of supporting posts 28,29 is not critical, and posts 28,29 are simply used to maintain constant and fixed the back distance 55, or Tb, between ground plane 14 and radiating element 12. In this manner, the angle of inclination 50 of radiating element 12 to ground plane element 14, and the physical separation of radiating element 12 from ground plane 4, are held constant.

The front distance 54, or Tf, that exists between front edge 16 of radiating element 12 and ground plane 14 can be established using the same support techniques as described above relative to Tb. However, it is preferred to minimize the volume of any spacers that exist in space 60 between ground plane 14 and radiating element 12. Thus, it is preferred that the front distance 54 or Tb be established by using the physical rigidity and structural support that is provided by inner conductor 22 within feed cable 20, as is shown in FIGS. 1, 2 and 3.

As a result, radiating element 12 is physically held, or supported, above ground plane 14 by means of three support points; i.e., conductor 22 and two posts or bolts 28,29. The two side-disposed support points 28,29 establish the back separation Tb, while one centrally-disposed support point 22 establishes both the front separation Tf, and the antenna's feed point 26, as best seen in FIG. 1.

Ground plane 14 can be made from any relatively rigid, planar or curved, and electrically conductive material. As shown in FIG. 1, ground plane 14 is provided with two linear side edges 31,32 (defined as the length dimension GPl of ground plane 14) that are generally parallel to each other, and generally parallel to the corresponding edges 17,19 of radiating element 12. Ground plane 14 is also provided with other two other linear edges 33,34 (defined as the width dimension GPw of ground plane 14) that extend generally parallel to the corresponding edges 18,16 of radiating element 12, edges 33,34 also extending generally perpendicular to edges 31,32.

Figure 10:
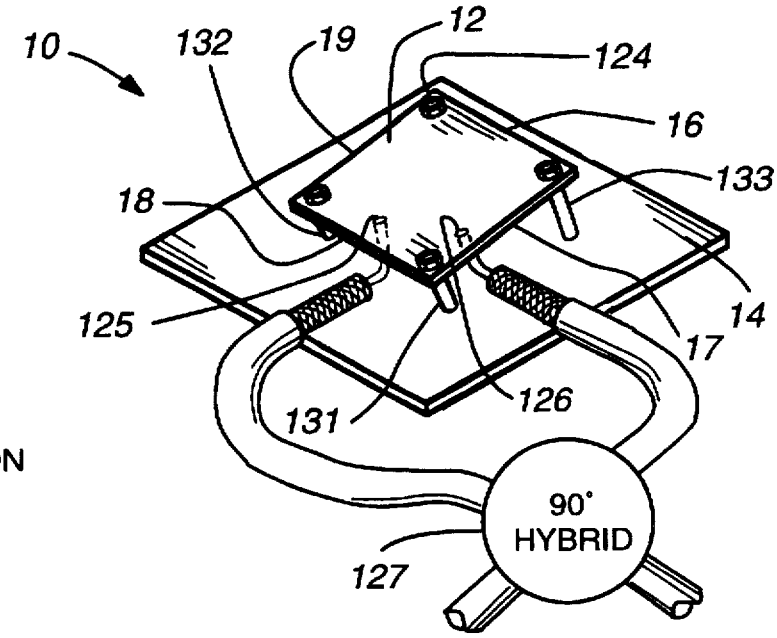
FIGS. 10 and 11 show antennas in accordance with the invention, wherein the antenna radiating element is tilted in such a manner that all four of edges, or sides, of the radiating element are inclined to the antenna ground plane element, FIG. 10 showing a feed that results in circular polarization, and FIG. 11 showing a feed that results in dual polarization.
Figure 11:
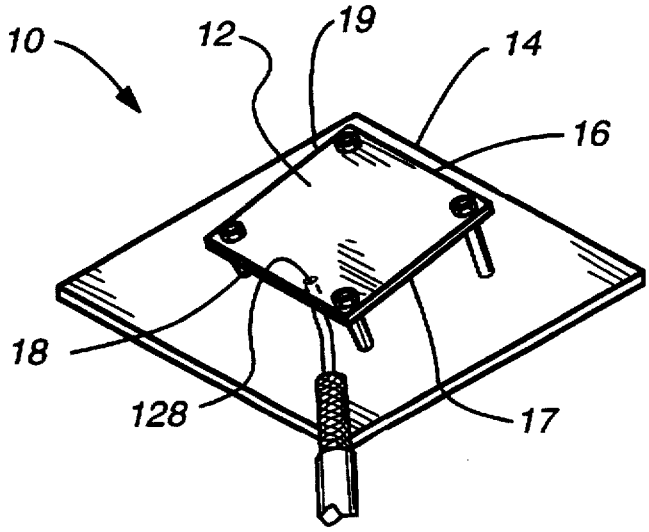

While FIGS. 1–3 show an embodiment of the invention wherein only edges 17,19 of radiating element 12 are inclined to ground plane element 14, it is within the spirit and scope of this invention to provide support of radiating element 12 in a manner such that all four of its edges 16–19 are inclined to ground plane element 14, as seen in FIGS. 10 and 11.

The thickness 70 of ground plane is generally not critical to operation of the antenna. The conductive material of ground plane 14 should be structurally self supporting, or the upper electrically conductive surface of ground plane 14 should be mounted on a structurally rigid backing that operates to provide the required structural strength. Some common materials for ground plane 14 are a solid metal sheet, and a single or a double clad copper substrate. One-half ounce single clad copper substrate is generally acceptable.

The size of a flat or a curved ground plane 14 is not critical, with the exception that it must be larger than, or at least as large as, the size of radiating element 12, or else the gain and/or back radiation 71 of the antenna will be effected. In a preferred embodiment, the length 31,32 of ground plane 14, defined as GPl, was about twice the length 47 (17,19 or L) of radiating element 12, defined as L, and the width 33,34 of ground plane 14, defined as GPw, was about twice the width 53 (16,18, or W) of radiating element 12.

It is preferred that ground plane 14 generally be of the same geometric shape as radiating element 12, as is shown in FIG. 1. Stated in another way, if ground plane 14 has N sides, then it is preferred that radiating element also have N sides, with corresponding sides of the ground plane and the radiating element being supported in general spaced or vertical alignment.

Generally, the larger the size of ground plane 14, the less power that is radiated to the back of the antenna; i.e., the less power that is radiated in the direction 71 of FIGS. 2 and 3. Thus, the larger the physical size of ground plane 14, the larger will be the front-to-back radiating ratio of the antenna. The physical size of ground plane 14 generally varies with the physical size of radiating element 12, the size of ground plane 14 always being equal-to or larger-than the size of radiating element 12. A larger size ground plane 14 provides higher front-to-back antenna ratios, the resulting increase in the antenna's front radiation 72 operating to increases the directive gain of the antenna.

While in theory, ground plane 14 can be very large, and the larger ground plane 14 is, the more directional will be the antenna; i.e., the more power that will be radiated in the direction 72 of FIGS. 2 and 3, use of a very large ground plane 14 results in a very large antenna. Thus, the size of ground plane 14 is generally limited by aesthetic considerations. When ground plane 14 is the same size as radiating element 12, the antenna is an omni-directional antenna; i.e., significant power is radiated in both direction 72 and direction 71 of FIGS. 2 and 3. When ground plane 14 is appreciably larger than radiating element 12, the antenna is a directional antenna, radiating primarily in direction 72.

The physical placement of feed point 26 within the area of the under surface of radiating element 12, best seen in FIG. 1 and defined as distance 80 or Fp, is important relative to matching the antenna's impedance to the impedance of feed cable 20. Inner conductor 22 of feed cable 20 is electrically and mechanically secured to radiating element 12 at feed point 26, thus providing feed to radiating element 12 at the distance 80 or Fp from its front edge 16.

The outer insulation of cable 20 is physically secured to ground plane 14, for example by the use of an epoxy, in order to provide a reliable and physically solid electrical connection 26 of feed conductor 22 to radiating element 12. Feed conductor 22 is typically soldered, or electrically connected to the bottom conductive surface of radiating element 12 at feed point 26, and the cable's metal sheath 24 is typically soldered, or electrically connected to the upper conductive surface of ground plane 14.

The distance 80 or Fp is typically in a range that extends from a point generally coincident with edge 16, to ½ of the dimension 47, L. The vertical height of feed point 26 is, of course, related to the height dimension 54, Tf.

An antenna in accordance with this invention can be fed by numerous means, using any on the known types of connector/cable assemblies. For example, antenna feed can be as shown utilizing coaxial cable 20 with the cable's outer conductor 24 preferably soldered to ground plane 14. Alternatively, a standard-construction connector (eg: SMA, Type N, BNC, etc.) can be soldered to ground plane 14 to facilitate the connection of a feed cable to the antenna.

In addition, the cable's inner conductor 22 can extend from the back side of ground plane 14 (i.e., the side opposite to radiating element 12) and upward to radiating element 12, conductor 22 can extend from the top of ground plane 14 and upward to radiating element 12 as shown in FIGS. 1–3, or conductor 22 can extend upward from either side 31, 32 of ground plane The preferred method for directly attaching coaxial cable 20 to the top and conductive surface of ground plane 14 is by soldering the cable's outer conductor or sheath 24 to this top surface of ground plane 14, bending the cable's exposed inner conductor 22 upward about 90-degrees, and then electrically securing the upper end of conductor 22 to the bottom conductive surface of radiating element 12. In this way, both electrical feed and mechanical support are provided for this portion of radiating element 12. This construction and arrangement is illustrated in FIGS. 1–3.

The bandwidth of an antenna in accordance with this invention is typically 8%, and values from 3% to 10% are common, depending upon design factors. Generally, a higher bandwidth is achieved by increasing the distance that exists between ground plane 14 and radiating element 12. If greater bandwidth is desirable, then back dimension 55 or Tb can be increased. The front dimension 54 or Tf remains about the same regardless of the value of Tb.

In considering antenna gain/efficiency, the maximum directive gain of an antenna in accordance with this invention typically lies in the range of from about 8.5 dBi to about 11 dBi. The higher component of this range is achieved by attaching a feed cable directly to ground plane 14 as in FIGS. 1–3, this construction operating to generally eliminate or minimize cable length. An antenna in accordance with this invention generally has no signal loss mechanism, and is thus nearly 100% efficient when matched at a minimum VSWR of 1.0001:1.

Figure 7:
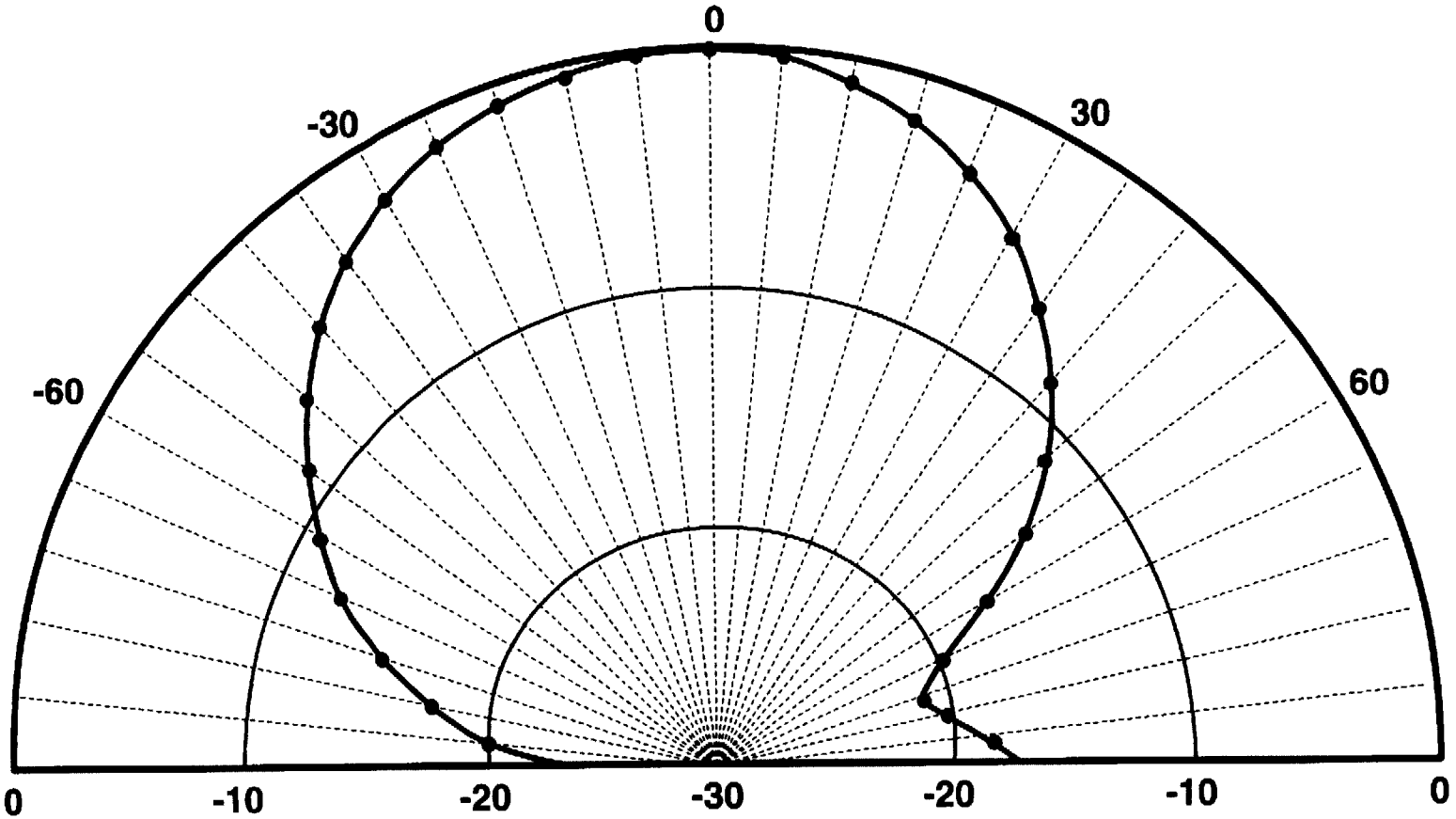
FIG. 7 is a typical E-plane signal radiation/reception pattern for an antenna in accordance with the present invention.
Figure 8:
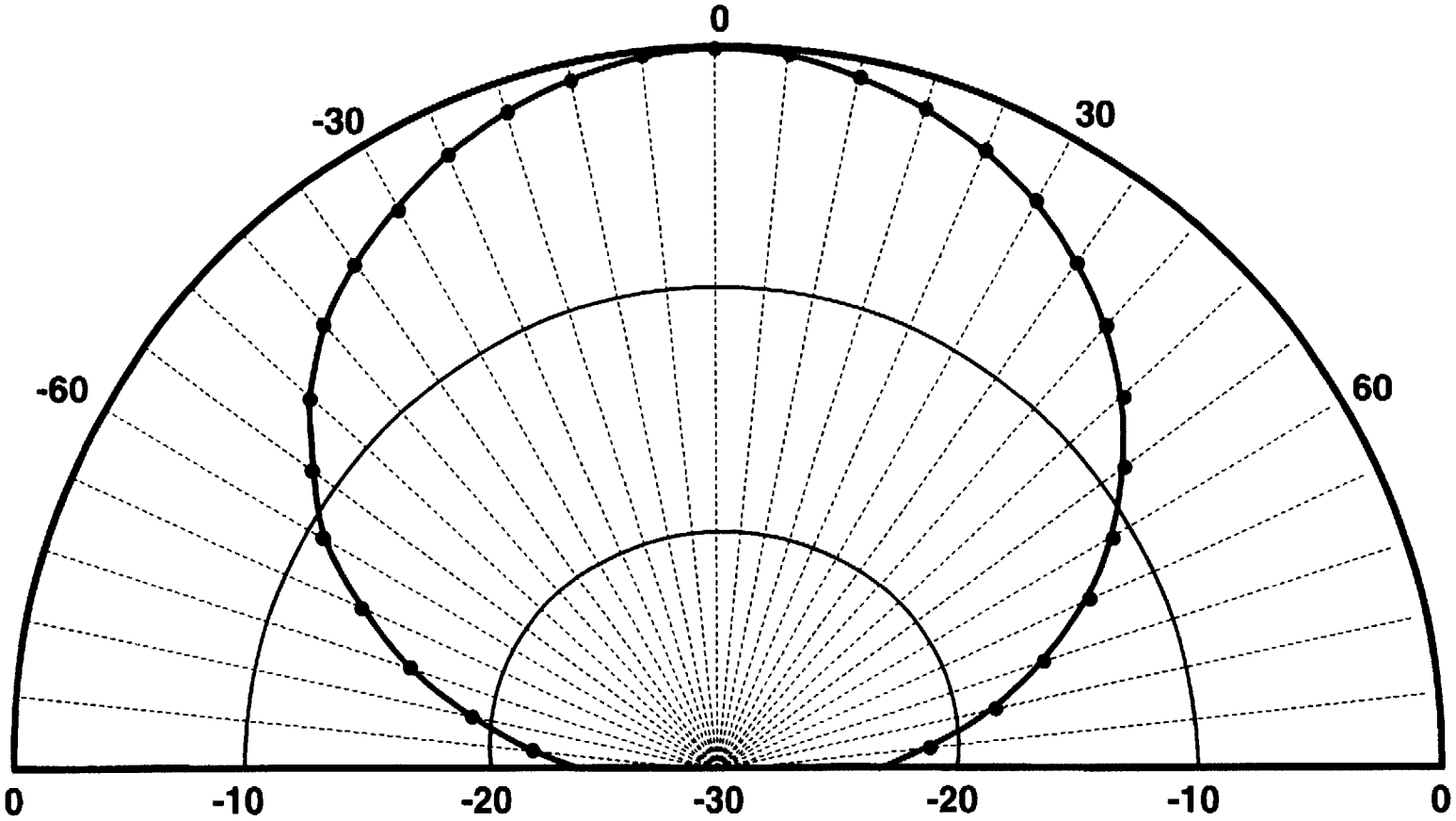
FIG. 8 is a typical H-plane signal radiation/reception pattern for the antenna of FIG. 7.

The antenna beamwidth of this invention provides an even and rounded single radiation lobe, having a slight down tilt of from about 2 to about 3-degrees as measured in the direction of Tf. A typical value for H-plane is 60-degrees, and a typical value for E-plane is 55-degrees. FIG. 7 shows a typical E-plane signal radiation/reception pattern for an antenna of the present invention, and FIG. 8 shows a typical H-plane signal radiation/reception pattern for the antenna of FIG. 7. This example antenna had a center frequency is about 2.45 Ghz, the antenna was linear, the antenna was directional, and the antenna had a gain of 9 Db.

The beamwidth of an antenna in accordance with this invention provides an advantage when the antenna is used with wireless communications base stations, because the beamwidth operates to maximize the power that is transmitted to the users, and reduces power transmitted to distant base stations, when using the same frequency or digital code.

The process that is used to adjustably build a prototype antenna in accordance with this invention, which prototype antenna will operate at a given frequency for which the physical configuration of an antenna in accordance with this invention has, as yet, not been determined, starts with cutting a radiating element 12 to the size as specified by the above equations for W and L.

Thereafter, the following sequential steps are performed:

1. Drill two ⅛" holes approximately ¼ inch inward from the two corners of radiating element 12 at the intersection of sides 17,19 with side 18.

2. Thread a first nut 77 onto a ⅛th-inch nylon bolt 75, so that the distance from the bolt's head 78 to nut 77 is about equal to Tb (see FIG. 9). Repeat for a 2nd bolt 75. This step will fix the antenna's distance Tb, which can be adjusted later.

3. Place the two bolts 75 through two of the drilled holes in radiating element 12, adjacent to its far edge 18.

4. Thread a second nut 79 onto the two nylon bolts 75 until the second nut 79 is tight against the upper surface of radiating element 12.

5. Strip the outer insulation from about 1-inch of the end of cable 20, thus leaving about 1-inch of outer braid 24 exposed.

6. Strip the inner conductor's insulation back about ½-inch, thus leaving about ½ inch of bare inner conductor 22 exposed.

At this point, about ½-inch of inner conductor is exposed, about ½-inch of outer braid 24 is exposed, and a length of cable 20 remains.

7. Tin the cable's outer braid 24 with solder.

8. Cut ground plane 14 to dimensions specified above for Gpl and Gpw.

9. Physically center radiating element 12 on the top surface of ground plane 14, and then mark the outline of radiating element 12 on this top surface of ground plane 14. Remove radiating element 12.

10. Solder the cable's outer braid 24 outside of the marked outline of radiating element 12 on the top surface of ground plane 14, making sure that the end of the cable's outer conductor 22 is about 0.2-inches outside of the marked outline of radiating element 12.

11. Bend the cable's inner conductor 22 upward and away from ground plane 14, at an angle of about 90-degrees.

12. Trim the cable's inner conductor 22 so that the vertical height of its trimmed end is from about 0.2 to about 0.3-inches above ground plane 14.

13. Place radiating element 12 over the marked top surface of ground plane 14, with the two bolt heads 78 resting on the top surface of ground plane 14, and with the edge 16 of radiating element 12 sitting on top of the cable's inner conductor 22. Start with inner conductor 22 at edge 16 of radiating element 12 so that dimension 80, or Fp, essentially equals 0-inches. Temporarily fasten radiating element 12 to ground plane 14 with slight pressure, for example, by using a rubber band.

14. Connect cable 20 to a network analyzer and select a VSWR graph.

15. Slide radiating element 12 along its dimension 47, the L axis, thus moving edge 16 of radiating element 12 away from inner conductor 22, and thereby increasing dimension 80, Fp.

16. Upon visually identifying a desirable VSWR pattern, proceed to the "FIXING STEP" Otherwise increase dimension 55, Tb, by adjusting the two bolts' nylon nuts 77, 79, and repeat steps 16 and, 17. It may also be necessary to decrease dimension 80, Fp, and then repeat step 16, 17. Adjusting dimension 55, Tb, operates to increase or decrease the antenna's center frequency at the minimum VSWR point.

17. FIXING STEP—Now that the VSWR and frequency are properly matched, fix the components of the prototype antenna in place. For example, use the pin-point flame of a propane torch to heat the top surface of radiating element 12 directly above the point 26 where the cable's inner conductor 22 physically contacts or touches radiating element 12, and then reaching under radiating element 12, extend a piece of solder and touch the point 26 on radiating element 12 where the cable's inner conductor 22 touches radiating element 12 (i.e., on the side of radiating element 12 that is opposite to the propane flame and that faces ground plane 14). This operation provides a permanent and physically stable solder connection 26 between radiating element 12 and the cable's inner conductor 22.

18. Gently place quick-setting epoxy under the two nylon bolt heads 78 so as to physically secure the two bolt heads 78 to the top surface of ground plane 14. Apply glue to the four bolt nuts 77,79, to thereby secure them in place, whereupon the rubber band is removed.

This physical dimensions and construction of this prototype antenna are now used to mass produce antennas that will reliably operated at the above-mentioned frequency for which the prototype antenna was designed using the above method steps.

FIG. 4 is a table that provides the physical dimensions for three different physical antenna configurations that were designed using the above-described method, these three antennas being an antenna having a center frequency of 2440 Mhz, an antenna having a center frequency of 1964 MHz, and an antenna having a center frequency of 933 MHz. The dimensions shown in FIG. 4 are in inches. As can be seen from FIG. 4, the area of radiating element 12 is in the range of from about 18 to about 30 percent of the area of ground plane 14.

It is desirable in some operating environments to provide the antenna with a radome or other protective cover. This construction and arrangement enables the antenna to be used both indoor and outdoors. The use of a radome typically shifts the center frequency of the antenna, usually downward. However, it is possible to compensate for this frequency shift when designing the antenna.

FIG. 5 is a top plan view of antenna 10 of FIG. 1, wherein a plastic radome 90 has been added to physically cover and protect antenna 10. FIG. 6 is a section view of FIG. 5 wherein the radome-covered antenna is viewed from the side opposite to cable 20; i.e., the side that provides a view of the back edge 18 of radiation element 12, as is shown by section line 6—6 of FIG. 5.

The present invention lends itself to either vertical or horizontal polarization. Vertical polarization is achieved by mounting the antenna such that ground plane 14 is coplanar with a vertical mounting surface, and with the antenna's Tf side, or side 16 points downward toward the earth's surface. Horizontal polarization is attained by mounting the antenna the same as for vertical polarization, except that the antenna's Tf side, or side 16, extends along an axis that is parallel to the earth's surface.

The tilting of radiating element 12 in a manner so that all four of its edges or sides 16–19 are inclined to ground plane element 14 is shown in FIGS. 10 and 11. In FIGS. 10 and 11, the bottom metallic surface of radiating element 12 is supported above, or on top of, the top metallic surface of ground plane element 14 by way of four small cross sections, dielectric, and electrically insulating posts 130, 131,132,133 of progressively increasing length, as is shown by the corresponding dimensions of FIGS. 10 and 11. That is, the corner of radiating element 12 that is supported by post 131 is the closest to ground plane element 14, and the corner of radiating element 12 that is supported by post 134 is the farthest from ground plane element One advantage of the tilt construction and arrangement shown in FIGS. 10 and 11 is that antenna 10 can be fed in a manner to provide either circular or dual polarization.

FIG. 10 shows a circular polarization construction and arrangement wherein the antenna's radiating element 12 is fed at two feed points 125, 126 that are respectively at 0-degrees and 90-degrees phase, as is provided by a well-known 90-degree hybrid device 127 wherein device 127 is fed by a 0-degrees conductor 140 and a 90-degree conductor 141. In the construction and arrangement of FIG. 10, a dual polarization antenna results when hybrid device 127 is eliminated, and a switching device is used to provide feed to the two points 125, 126.

FIG. 11 shows a dual polarization construction and arrangement wherein the antenna's radiating element 12 is fed at a single point 128 that is located on a diagonal of the surface of radiating element 12. In the construction and arrangement of FIG. 11, a circular polarization antenna results when the dimensions of radiating element 12 are adjusted to provide circular polarization.

While the invention has been described above in detail while making reference to embodiments wherein radiating element 12 and ground plane element 14 are both flat and planar elements, the spirit and scope of the invention is not to be limited to these specific geometric shapes.

Figure 12:
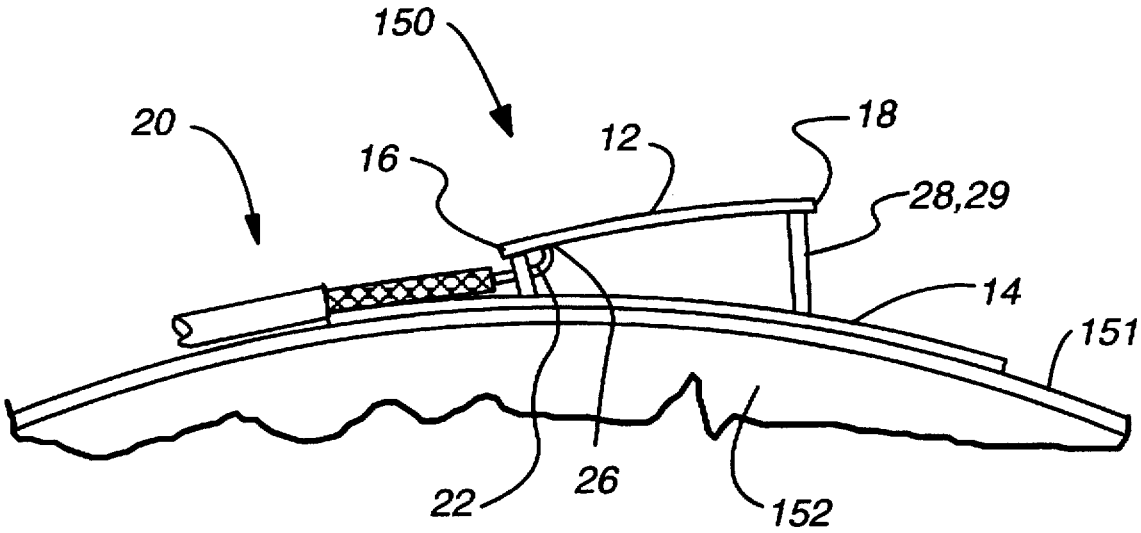
FIG. 12 shows an antenna in accordance with the invention, wherein both the antenna's ground plane element and the antenna's radiating element are formed as portions of generally circular cylinders; that is, the curved ground plane element and the curved radiating element are both formed about axes that extend generally perpendicular to the plane of the figure.

FIG. 12 is a side view, generally similar to FIGS. 2 and 3, wherein both ground plane element 14 and radiating element 12 are formed as portions of generally circular cylinders; i.e., curved ground plane element 14 and curved radiating element 12 are both formed about axes that extend generally perpendicular to the plane of FIG. 12.

FIG. 12 shows antenna 150 in accordance with this invention as it is mounted directly on, i.e. in physical engagement with, the generally vertically extending, exterior, and generally cylindrical surface 151 of a support post 152. In the mounting attitude of FIG. 12, front side 16 of radiating element 12 extends vertically downward. As can be seen, the ever-increasing separation of radiating element 12 from ground plane element 14, as is progressively measured from the front edge 16 to the back edge 18 of radiating element 12, is achieved, as above described relative to using conductor 22 to support the front portion or radiating element 12 a relatively short distance above ground plane element 14, and by using support posts 28,29 to support the back portion of radiating element 12 at a relatively greater distance above ground plane element 14.

When support post 152 comprises a metal post, ground plane element 14 can be used as is shown in FIG. 12. However, with a metal support post 152, it is also possible to eliminated ground plane element 14, whereupon the metal surface 151 of post 152 functions as the antenna's ground plane element.

Also, it is within the spirit and scope of this invention to provide curved antenna 150 of FIG. 12 such that radiating element 12 is tilted relative to ground plane element 14, as was described relative to FIG. 3, and/or such that radiating element 12 is tilted relative to ground plane element 14, as was described relative to FIGS. 10 and 11. In addition, a radome may be provided for antenna 150 as was described relative to FIGS. 5 and 6.

While the exemplary preferred embodiments of the present invention are described herein with particularity, those having normal skill in the art will recognize various changes, modifications, additions and applications other than those specifically mentioned herein without departing from the spirit of this invention.

What is claimed is:

1. A microstrip antenna, comprising:

a metallic and generally planar ground plane element occupying a first physical plane, said ground plane element being formed as first quadrilateral having a first shape and a first physical size;

a metallic and generally planar radiating element, said radiating element being formed as second quadrilateral having second shape that is generally identical to said first shape of said first quadrilateral, said second shape being of a second physical size that is equal to or smaller than said first physical size;

mounting means positioning said radiating element at a fixed position and so as to be generally centered over said first physical size of said ground plane element, said mounting means operating to physically mount said radiating element away from said ground plane element so as to define a dielectric space between said radiating element and said ground plane element, said mounting means operating to mount said planar radiating element in an inclined attitude relative to said planar ground plane element; and signal feed means extending into said dielectric space, said signal feed means including metallic electrical conductor means fixed to a feed point on a surface of said radiating element that faces said ground plane element.

2. The antenna of claim 1 wherein said first and second quadrilateral shapes are selected from the group square and rectangular.

3. The antenna of claim 1 wherein said second size of said radiating element is in the range of from about 18% to about 30% of said first size of said ground plane element.

4. The antenna of claim 1 including:

a radome secured to said first shape and covering said ground plane element and said radiating element.

5. The antenna of claim 1 wherein said feed point comprises a point on said surface of said radiating element that is adjacent to a first edge of said radiating element, and wherein said mounting means comprises:

said metallic electrical conductor means operating to physically support said radiating element; and first and second dielectric-material and physically spaced support posts of generally equal length, each of said posts extending between said ground plane element and said radiating element, to engage said surface of said radiating element adjacent a second edge that is opposite to said first edge.

6. The antenna of claim 5 wherein said first and second support posts comprise linear posts having adjustable lengths.

7. The antenna of claim 6 wherein said second size of said radiating element is in the range of from about 18% to about 30% of said first size of said ground plane element.

8. A microstrip antenna, comprising:

a flat ground plane member;

said ground plane member having a flat top metallic surface that defines a first metallic area;

said first metallic area having first and second sides that are mutually parallel, and having second and third sides that are mutually parallel, and are perpendicular to said first and second sides;

a flat radiating member;

said radiating member having a flat bottom metallic surface that defines a second metallic area that is equal to or smaller than said first metallic area;

said second metallic area having first and second sides that are mutually parallel, and having second and third sides that are mutually parallel, and are perpendicular to said first and second sides;

dielectric mounting means physically engaging said first and second metallic surfaces and operating to mount said radiating member at a fixed position on said ground plane member with said second metallic area generally centered over said first metallic area;

said fixed position providing that respective first, second, third and fourth sides of said first and second metallic areas are parallel;

said mounting means operating to mount said radiating member out of physical engagement with said ground plane member, so as to define a dielectric space between said radiating member and said ground plane member;

said mounting means operating to mount said radiating member at an incline relative to said ground plane members so that said first edge of said second metallic area is positioned a first distance from said first metallic area, and so that said second edge of said second metallic area is positioned a second distance from said second metallic area;

said first and second distance being unequal; and antenna signal feed means extending into said dielectric space, said signal feed means including a metallic electrical conductor that is fixed to a feed point on said bottom surface of said radiating member that is adjacent to said first edge of said radiating member.

9. The antenna of claim 8 wherein said first distance is greater than said second distance.

10. The antenna of claim 8 wherein said second distance is greater than said first distance.

11. The antenna of claim 8 wherein said first metallic area and said second metallic area are selected from the group square-shaped area and rectangular-shaped area.

12. The antenna of claim 8 wherein said second metallic area is in the range of from about 18% to about 30% the size of said first metallic area.

13. The antenna of claim 8 including:

a radome covering said ground plane member and said radiating member.

14. The antenna of claim 13 wherein said radome comprises:

an box-like housing having four walls that define an open bottom that generally conforms to said first area; and means securing said four walls to said first, second, third and fourth sides of said first metallic area.

15. The antenna of claim 8 wherein said mounting means comprises:

said metallic electrical conductor means operating to physically support said radiating member at a first support point that is adjacent to said first edge of said second metallic area, and first and second dielectric-material, physically spaced support posts of generally equal length;

said first and second support posts individually extending between said first metallic area and second and third support points on said second metallic area that are adjacent to said second edge of said second metallic area.

16. The antenna of claim 15 wherein said first and second support posts comprise linear posts having adjustable lengths.

17. The antenna of claim 15 wherein said metallic electrical conductor means comprises a center conductor of a coaxial cable having a metallic sheath, and including:

means electrically connecting said metallic sheath to said first metallic area at a point that is adjacent to said first edge of said first metallic area.

18. The antenna of claim 15 wherein:

said dielectric space is an air dielectric space;

said first metallic area and said second metallic area are square-shaped areas; and said second area is in the range of from about 18% to about 30% of said first area.

19. The antenna of claim 18 wherein said first distance is greater than said second distance.

20. The antenna of claim 18 wherein said second distance is greater than said first distance.

21. A method of making a microstrip antenna in accordance with a desired standing wave ratio, said antenna having a ground plane member and a radiating member, said ground plane member providing a top metallic surface with a first edge and an opposite edge, and said radiating member providing a bottom metallic surface that faces said top metallic surface, said radiating member having a first edge and a second edge, the method comprising the steps of:

providing first mounting means physically engaging said top and bottom metallic surfaces adjacent to said first edges, and mounting said radiating member at a position overhanging said ground plane member, with said first edge of said bottom metallic surface being located a first distance from said top metallic surface;

providing adjustable length dielectric mounting means engaging said top and bottom metallic surfaces adjacent to said second edges, and mounting said radiating member at said position overhanging said ground plane member, with said second edge of said bottom metallic surface being located at a second distance from said top metallic surface;

said first and second distances being unequal so as to position said second metallic surface at an incline to said first metallic surface;

applying a signal to a feed point on said second metallic surface adjacent to said first edge of said second metallic surface;

monitoring a standing wave ratio of said antenna for an occurrence of said desired standing wave ratio;

iteratively (1) moving said feed point relative to said first edge of said second metallic surface, and/or (2) changing said second distance, until said monitored standing wave ratio is generally equal to said desired standing wave ratio; and upon said monitored standing wave ratio being generally equal to said desired standing wave ratio, measuring a location of said feed point on said second metallic surface, and measuring said second distance.

22. The method of claim 21 including the step of:

mass producing antennas having said desired standing wave ratio by using said first distance, said measured location of said feed point on said second metallic surface, and said measured second distance to construct said mass produced antennas.

23. The method of claim 21 including the step of:

providing a radome for each of said mass produced antennas.

24. A microstrip antenna, comprising:

a metallic ground plane element having a first shape and a first size;

a metallic radiating element, said radiating element having second shape that is generally identical to said first shape, said second shape being of a second size that is equal to or smaller than said first size;

mounting means positioning said radiating element at a fixed position and so as to be generally centered over said ground plane element, said mounting means operating to physically mount said radiating element away from said ground plane element so as to define a dielectric space between said radiating element and said ground plane element, said mounting means operating to mount said radiating element in an inclined attitude relative to said ground plane element; and signal feed means extending into said dielectric space, said signal feed means including metallic electrical conductor means fixed to a feed point on a surface of said radiating element that faces said ground plane element.

25. The antenna of claim 24 wherein said first and second shapes are both selected from the group flat-planar shape or partial-cylinder shape.

26. The antenna of claim 24 wherein said second size of said radiating element is in the range of from about 18% to about 30% of said first size of said ground plane element.

27. The antenna of claim 24 including:

a radome secured to said ground plane element and covering said ground plane element and said radiating element.

28. The antenna of claim 24 wherein said feed point comprises a point on said surface of said radiating element that is adjacent to a first edge of said radiating element, and wherein said mounting means comprises:

said metallic electrical conductor means operating to physically support said radiating element; and first and second dielectric-material and physically spaced support posts, each of said posts extending between said ground plane element and said radiating element, to engage said surface of said radiating element adjacent a second edge that is opposite to said first edge.

29. The antenna of claim 28 wherein said second size of said radiating element is in the range of from about 18% to about 30% of said first size of said ground plane element, and wherein said first and second shapes are both selected from the group flat-planar shape or partial-cylinder shape.

30. A microstrip antenna, comprising:

a ground plane member formed as a partial cylinder, said ground plane member having a curved top metallic surface with a plurality N of sides;

a radiating member formed as a partial cylinder, said radiating member having a curved bottom metallic surface with said plurality N of sides;

dielectric mounting means physically engaging said first and second metallic surfaces and operating to mount said radiating member at a fixed position on said ground plane member with said second metallic surface generally centered over said first metallic surface;

said fixed position providing that corresponding sides of said first and second metallic surfaces are in general alignment;

said mounting means operating to mount said radiating member out of physical engagement with said ground plane member, so as to define a dielectric space between said radiating member and said ground plane member;

said mounting means operating to mount said radiating member at an incline relative to said ground plane member; and antenna signal feed means extending into said dielectric space, said signal feed means including a metallic electrical conductor that is fixed to a feed point on said bottom surface of said radiating member.

31. The antenna of claim 30 wherein said mounting means operates to mount said radiating member at said incline relative to said radiation member such that all points on said radiating member are at different distances from corresponding underlying points on said ground plane member.

32. The antenna of claim 30 wherein N equals four, and wherein said mounting means operates to mount said radiating member at said incline relative to said ground plane member such that first sides of said radiating member and said ground plane member are parallel and spaced a first distance, such that second opposite sides of said radiating member and said ground plane member are parallel and spaced a second distance that is greater than said first distance, such that third sides of said radiating member and said ground plane member are non-parallel and are spaced an increasing distance as measured from said first side to said opposite second side, and such that fourth sides of said radiating member and said ground plane member are non-parallel and are spaced said increasing distance as measured from said first side to said opposite second side.

33. A microstrip antenna, comprising:

a ground member having a top metallic surface with a plurality N of sides;

a radiating member having a bottom metallic surface with said plurality N of sides;

dielectric mounting means physically engaging said first and second metallic surfaces and operating to mount said radiating member at a fixed position on said ground member with said second metallic surface generally centered over said first metallic surface;

said fixed position providing that corresponding sides of said first and second metallic surfaces are in general alignment;

said mounting means operating to mount said radiating member out of physical engagement with said ground member, so as to define a dielectric space between said radiating member and said ground member;

said mounting means operating to mount said radiating member at an incline relative to said ground member; and antenna signal feed means extending into said dielectric space, said signal feed means including a metallic electrical conductor that is fixed to a feed point on said bottom surface of said radiating member.

34. The antenna of claim 33 wherein said mounting means operates to mount said radiating member at said incline relative to said radiation member such that all points on said radiating member are at different distances from corresponding underlying points on said ground member.

35. The antenna of claim 33 wherein N equals four, and wherein said mounting means operates to mount said radiating member at said incline relative to said ground member such that first sides of said radiating member and said ground member are parallel and spaced a first distance, such that second opposite sides of said radiating member and said ground member are parallel and spaced a second distance that is greater than said first distance, such that third sides of said radiating member and said ground member are non-parallel and are spaced an increasing distance as measured from said first side to said opposite second side, and such that fourth sides of said radiating member and said ground member are non-parallel and are spaced said increasing distance as measured from said first side to said opposite second side.

36. A microstrip antenna, comprising:

a generally planar ground plane element in the shape of a first quadrilateral having a first physical size, said ground plane element having an upper metal surface;

a generally planar radiating element in the shape of a second quadrilateral that is generally identical to said first quadrilateral, said second quadrilateral being of a second physical size that is equal to or smaller than said first physical size, said radiating element having a lower metal surface;

mounting means positioning said radiating element at a fixed position and so as to be generally centered over said ground plane element;

said mounting means operating to physically mount said radiating element away from said ground plane element so as to define a dielectric space between said radiating element and said ground plane element;

said mounting means operating to mount said planar radiating element at an incline relative to said planar ground plane element in such a manner that all points on said top metal surface are spaced at a different distance from a corresponding point on said bottom metal surface; and signal feed means extending into said dielectric space, said signal feed means including metallic electrical conductor means fixed to said bottom metal surface of said radiating element.

37. The antenna of claim 36 wherein said first and second quadrilaterals are selected from the group square and rectangular.

38. The antenna of claim 36 wherein said second size is in the range of from about 18% to about 30% of said first size.

39. The antenna of claim 36 including:

a radome secured to said ground plane element and covering said radiating element.

40. The antenna of claim 36 wherein said signal feed means comprises:

a first and a second feed conductor connected to said lower metal surface in a manner to provide a circular polarized antenna.

41. The antenna of claim 36 wherein said signal feed means comprises:

a feed conductor connected to said lower metal surface in a manner to provide a dual polarized antenna.

42. An omni-directional/directional microstrip antenna, comprising:

a ground plane element having a first physical size, said ground plane element having an upper metal surface;

a radiating element having a second physical size, said radiating element having a lower metal surface;

mounting means positioning said radiating element at a fixed position and so as to be generally centered over said ground plane element;

said mounting means operating to physically mount said radiating element out of physical engagement with from said ground plane element so as to define a dielectric space between said radiating element and said ground plane element;

said mounting means operating to mount said planar radiating element at an incline relative to said planar ground plane element; and signal feed means extending into said dielectric space, said signal feed means including metallic electrical conductor means fixed to said bottom metal surface of said radiating element;

wherein when said first physical size is appreciably greater than said second physical size said antenna is directionally, and when said first physical size is generally equal to said second physical size said antenna is omni-directional.

* * * * *